US008882261B2

(12) United States Patent
Spence et al.

(10) Patent No.: US 8,882,261 B2
(45) Date of Patent: Nov. 11, 2014

(54) LARGE SHEET HANDLING USING A FLATBED CART

(75) Inventors: James Joseph Spence, Honeoye Falls, NY (US); Norman David Robinson, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 182 days.

(21) Appl. No.: 13/464,356

(22) Filed: May 4, 2012

(65) Prior Publication Data

US 2013/0293652 A1 Nov. 7, 2013

(51) Int. Cl.
*B41J 2/01* (2006.01)

(52) U.S. Cl.
USPC ..... 347/104

(58) Field of Classification Search
USPC ..... 347/104
See application file for complete search history.

(56) References Cited

U.S. PATENT DOCUMENTS

| | | | | |
|---|---|---|---|---|
| 4,547,786 | A * | 10/1985 | Logan et al. | 347/43 |
| 5,090,555 | A * | 2/1992 | Kura | 198/465.1 |
| 6,739,246 | B2 * | 5/2004 | Lan | 101/115 |
| 7,008,128 | B1 * | 3/2006 | Nakanishi | 400/578 |
| 7,014,033 | B2 * | 3/2006 | Sticht et al. | 198/465.1 |
| 7,267,499 | B2 * | 9/2007 | Nakanishi | 400/578 |
| 7,597,187 | B2 * | 10/2009 | Bausenwein et al. | 198/619 |
| 8,226,193 | B2 * | 7/2012 | Sugahara | 347/13 |
| 8,498,001 | B2 * | 7/2013 | Zach | 358/1.14 |
| 2007/0068403 | A1 * | 3/2007 | Fresener et al. | 101/115 |
| 2009/0321220 | A1 * | 12/2009 | Ewerlof | 198/345.3 |

* cited by examiner

*Primary Examiner* — Laura Martin
*Assistant Examiner* — Jeremy Bishop
(74) *Attorney, Agent, or Firm* — Hoffmann & Baron, LLP

(57) ABSTRACT

Disclosed is an apparatus for handling a sheet of substrate media in a marking assembly. The apparatus includes a rail support track, a first marking zone and a first platen cart. The rail support track forms a closed path. The first marking zone marks a sheet of substrate media. Also, the first platen cart moves along the rail support track. The first platen cart recirculating around the closed path. The first platen cart conveying the sheet of substrate media in a process direction along at least a portion of the closed path through the first marking zone.

15 Claims, 8 Drawing Sheets

LARGE SHEET HANDLING USING A FLATBED CART

TECHNICAL FIELD

The present disclosure relates to an apparatus for and method of transporting large cut sheets of substrate media on a platen cart conveyed on a modular recirculating rail system.

BACKGROUND

High speed inkjet marking devices for large sized cut sheets are particularly constrained using contemporary systems with regard to production output, media type and image quality. Also, such systems tend to be inflexible and difficult to change or modify, particularly with regard to their automated components. Thus, when additional or different print cells, types of marking or sheet handling systems need to be used, one system may not be able to accommodate the entire job.

Also, document processing devices, including high speed inkjet printing assemblies, include systems for transporting sheets of substrate media there-through. In order to increase the throughput of the device, the transport systems are designed to move the media rapidly along a media processing path. However, transporting large media such as cut sheets as large as 60"×40", can be more difficult. Large media can be harder to hold flat across a large printing zone. Also, image quality can be an issue when printing across a large printing zone.

Contemporary large sheet printers use a multi-pass system in which a sheet of paper moves under fixed heads multiple times or the heads move over the paper multiple times. Multiple passes between the print heads and the sheet reduce productivity by slowing down production and tend to diminish image quality due to the difficulties in targeting the sheet in the desired location on different passes.

Accordingly, it would be desirable to provide a flexible, efficient and cost effective media transport system and method for marking large size cut sheets that maintains high quality output within a single system and that overcomes other shortcomings of the prior art.

SUMMARY

According to aspects described herein, there is disclosed an apparatus handling a sheet of substrate media in a marking assembly. The apparatus includes a rail support track, a first marking zone and a first platen cart. The rail support track forms a closed path. The first marking zone marks a sheet of substrate media. Also, the first platen cart moves along the rail support track. The first platen cart recirculating around the closed path. The first platen cart conveying the sheet of substrate media in a process direction along at least a portion of the closed path through the first marking zone.

Additionally, the rail support track can include at least one alternate route within the closed path. The first platen cart selectively moveable along the at least one alternate route. Also, the at least one alternate route can extend parallel to the portion of the closed path through the first marking zone. The rail support track can include at least one lateral shuttle section for moving the first platen cart between parallel sections of the closed path. The rail support track can include modular track sections formed as reconfigurable units for changing the closed path. The first marking zone can include a printing assembly. The printing assembly can be moveable in a cross-process direction across the portion of the closed path. The printing assembly can be an inkjet assembly marking the sheet with no more than a single cross-process direction pass of the sheet. Additionally, the apparatus can include a second platen cart moveable along the rail support track. The second platen cart can be moveable separate and apart from the first platen cart. The substrate media can be a cut sheet having dimensions of at least forty inches by sixty inches. The apparatus can further include a second marking zone for marking the sheet of substrate media. The first platen cart can convey the sheet of substrate media along at least a portion of the closed path through the second marking zone.

According to further aspects described herein, there is disclosed a method of handling sheets of substrate media in a marking assembly. The method includes positioning a first sheet of substrate media on a first platen cart. The first platen cart being disposed in a loading zone of a closed path. The first platen cart moveable in a process direction around the closed path returning the first platen cart to the loading zone. Additionally, the method includes moving the first platen cart in the process direction along the closed path to a first marking zone. The first platen cart conveying the first sheet of substrate media to the first marking zone. Additionally, the method includes marking the sheet of substrate media in the first marking zone. Additionally, the method includes removing the sheet of substrate media from the first platen cart. Also, the method includes moving the first platen cart further in the process direction along the closed path at least until the first platen cart reaches the loading zone.

Additionally, moving the first platen cart further in the process direction can include conveying the first platen cart laterally between parallel straight section of the closed path. Positioning a second sheet of substrate media on the first platen cart in the loading zone. Moving the first platen cart in the process direction along an alternate route within the closed path. Marking the sheet of substrate media can include moving a printing assembly in a cross-process direction across the path in the marking zone. The printing assembly can be an inkjet assembly marking the sheet with no more than a single cross-process direction pass of the sheet. Positioning a third sheet of substrate media on a second platen cart while the second platen cart is disposed in the loading zone and the first platen cart is disposed outside the loading zone. The second platen cart can be moveable in the process direction around the closed path returning the second platen cart to the loading zone. Moving the first platen cart in the process direction along the closed path to a second marking zone. The first platen cart can convey the first sheet of substrate media to the second marking zone. Marking the sheet of substrate media in the second marking zone. The positioning of the first sheet of substrate media on the first platen cart can be performed by an automated robotic arm. The automated robotic arm can receive the sheet from off the first platen cart. The first platen cart can move on wheels along at least a portion of the closed path.

DETAILED DESCRIPTION

Figure 1:
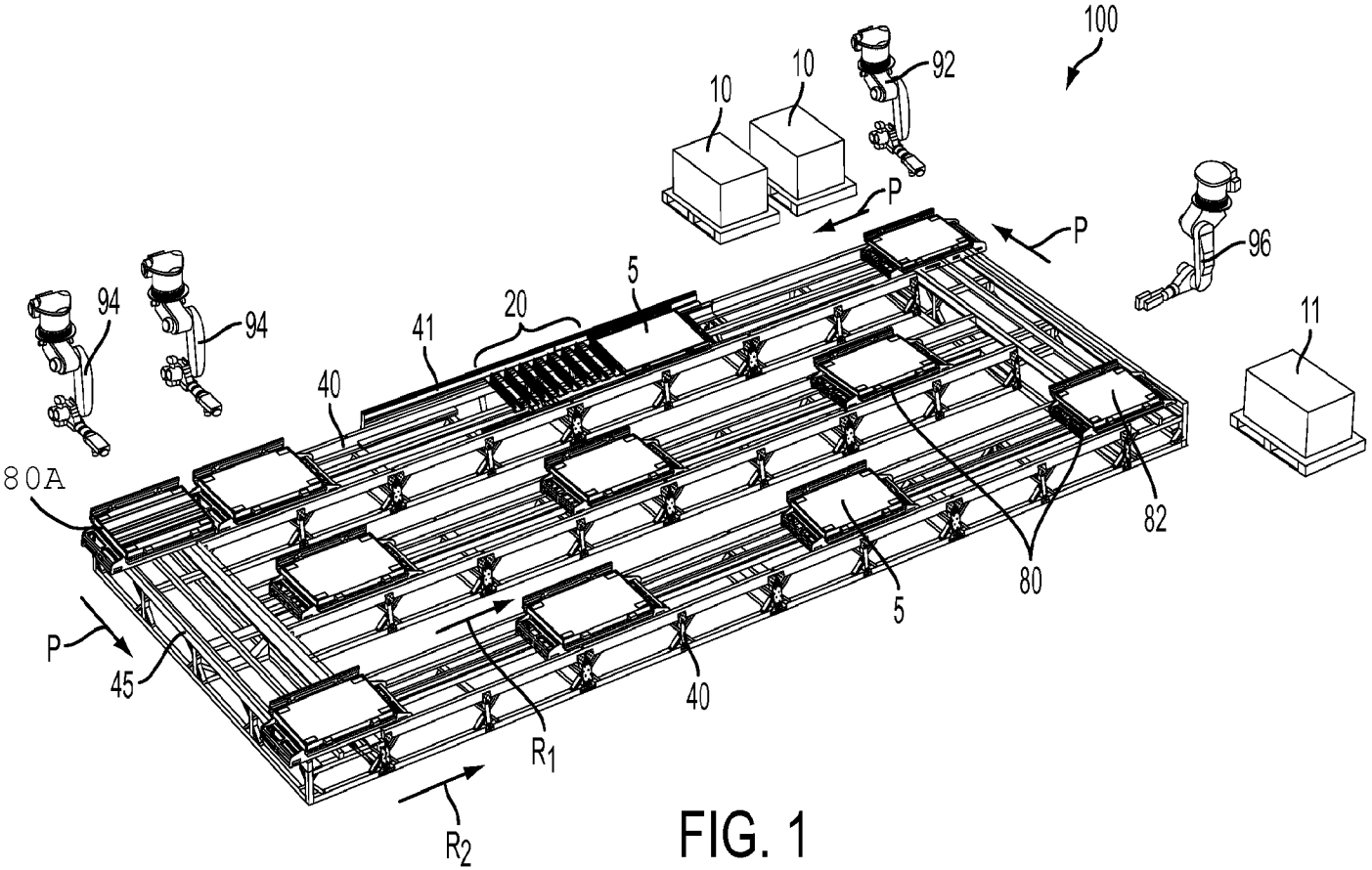
FIG. 1 is a perspective view of an apparatus for handling a sheet of substrate media in a marking assembly in accordance with an aspect of the disclosed technologies.

Describing now in further detail these exemplary embodiments with reference to the Figures. The disclosed technologies improve flexibility and image quality for large format print jobs, while providing an efficient sheet handling system that can improve productivity. The apparatus and methods disclosed herein can be used as a stand-alone system or adapted to work with further marking systems.

As used herein, "substrate media sheet", "substrate media" or "sheet" refers to a substrate onto which an image can be imparted. Such substrates may include, paper, transparencies, parchment, film, fabric, plastic, photo-finishing papers, corrugated board, or other coated or non-coated substrate media upon which information or markings can be visualized and/or reproduced. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in a process direction.

As used herein, "marking zone" refers to the location in a substrate media processing path in which the substrate media is altered by a "marking device." Marking devices as used herein include a printer, a printing assembly or printing system. Such marking devices can use digital copying, bookmaking, folding, stamping, facsimile, multi-function machine, and similar technologies. Particularly those that perform a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, the terms "process" and "process direction" refer to a process of moving, transporting and/or handling a substrate media sheet. The process direction substantially coincides with a direction of a flow path P along which a portion of the media cart moves and/or which the image or substrate media is primarily moved within the media handling assembly. Such a flow path P is said to flow from upstream to downstream. Accordingly, cross-process, lateral and transverse directions refers to movements or directions perpendicular to the process direction and generally along a common planar extent thereof.

As used herein, "cart", "media cart" or "platen cart" refers to a media transport device translatable along a process path for conveying a substrate media sheet. Such a media transport device includes a frame holding a platen for directly supporting the substrate media sheet thereon. A cart or media cart as described herein can include a sled running on rails, a conveyance having wheels in rolling engagement with a track, other moveable carriage structure and/or any combination thereof.

As used herein, the terms "module" or "modular" refer to one or more standardized part(s) from which a more complex structure can be assembled. Each of the parts being an independent component part interchangeable with other independent component parts. The individual modules being adapted to be combined with other modules to form all or part of the more complex structure.

Aspects of the disclosed technologies include a large modular conveyer system with multiple stations. The conveyer is particularly suited for large sized paper, which can be held down onto a platen residing on top of a wheel based cart. The cart translates along a looped rail system that constitutes a media path, within which multiple modules are disposed. The modules deliver the primary system functions, such as printing systems, sheet loading, sheet registration, sheet cleaning, ink curing, sheet unloading and various functions that make up a marking module system. Also, a single-pass inkjet marking design can provide a flexible and high quality output on large prints.

Additionally, the modular construction of the disclosed apparatus and the method of handling sheets to which it is applied enable different print cells to be selectively added and/or removed from the system as desired. Also, any type of chosen print head or other media handling device can be integrated into the system in order to match a desired image quality or output requirements that are reflective of customer needs and production costs.

With reference to FIG. 1, an apparatus 100 for handling a sheet of substrate media in a marking assembly is shown. The sheet handling apparatus 100 is suitable for handling high speed inkjet marking for large size cut sheet paper with flexibility in automation which can improve production output speed and quality and relieve limitations of sheet/image size, media type and image quality. The apparatus 100 includes a modular rail support track 40 designed to convey one or more platen carts 80. The platen carts 80 are moveable along the rail support track 40 conveying a substrate media sheet 5 in a process direction P. The substrate media 5 is held on a sheet platen 82 of the platen cart 80 as the cart moves along one or more portions of the process path, including one or more of the various routes $R_1$, $R_2$ of the rail support track 40. A supply of sheets 10 can be provided such that a loading apparatus 92 loads a sheet onto the platen cart 80 so it can be conveyed towards a marking zone 20 or other sheet marking or handling stations. Two other sheet handling stations that are shown include sheet inverters 94 and an unloading mechanism 96 for removing and collecting process sheets 11 from the apparatus 100.

Within the closed-loop process path defined by the rail support track 40, any number of other stations for application to the substrate media sheets 5 can be provided. For example, additional marking zones can be included, a sheet registration systems, paper cleaning elements, ink curing areas and various other functions that make up a sheet marking system. Considering the modular construction of the rail support track 40, these additional functions/features can be interchangeably added or removed from the system 100 as desired.

As shown, the rail support track 40 includes a series of linear sections. In the illustrative embodiment of FIG. 1, three linear sections run parallel to one another, while a pair of other linear sections extend perpendicular thereto at opposed ends of the three parallel sections. One of those parallel sections in FIG. 1 includes a marking zone 20. The pair of laterally extending track sections 45 at the opposed ends of the three parallel sections can provide a shuttling function for moving the media cart between desired ones of the three parallel sections. Alternatively, one or both of the laterally extending track sections 45 at the opposed ends can include a marking zone or other media handling assembly, such as a loading/unloading station. The laterally extending track sections 45 can include a supplemental translation cart 80A. Such a translation cart has an upper portion that resembles and is oriented in the same direction as the parallel rail support track 40. A lower portion of the translation cart is made to convey along the extent of the laterally extending track sections 45. Thus, as the media cart 80 reaches either one of the laterally extending track sections 45, a translation cart 80A could be positioned to receive it. Once the media cart 80 rides onto the upper portion of the translation cart 80A, it should stop so the translation cart can be moved along an extent of the laterally extending track section 45 in order to be conveyed to align with one of the other of the three parallel track sections. In this way, the media cart 80 need not rotate or turn in order to translate along those laterally extending sections of track. Thus, the translation carts each move back and forth along the extent of one laterally extending track, rather than recirculating around the entire rail support track 40. Generally, the laterally extending track section 45 should each only include a single translation cart 80A. However, if more than one translation cart 80A is used on the same section of laterally extending track 45, then an extension portion (not shown) can be added to the laterally extending track 45. Such an extension portion should extend a short distance beyond one of the outside parallel track sections so that one translation cart can move out of the way of one or more other translation carts on the same section of track.

Ultimately, the rail support track 40 is assembled into a closed-loop, allowing the platen carts 80 to circulate around the track 40. For example, a sheet from the supply 10 can be loaded onto the cart 80 by the loading mechanism 92. Thereafter, the media cart conveys a sheet 5 along the process direction P through the marking zone 20. Once the cart 80 reaches the shuttle section 45, the cart is conveyed laterally to one of the two routes $R_1$, $R_2$. In this way, the track 40 provides a looping rail system that forms a media path. As used herein, the term "loop" or "closed loop" with regard to the rail support track refers to a path that diverges from, and afterwards returning to, a starting point along the track. The loop can have alternative routes $R_1$, $R_2$, but preferably makes its way back to a common starting position. In this way, a platen cart 80 moving along the track 40 can re-circulate along one or more sections of the track 40.

Figure 2:
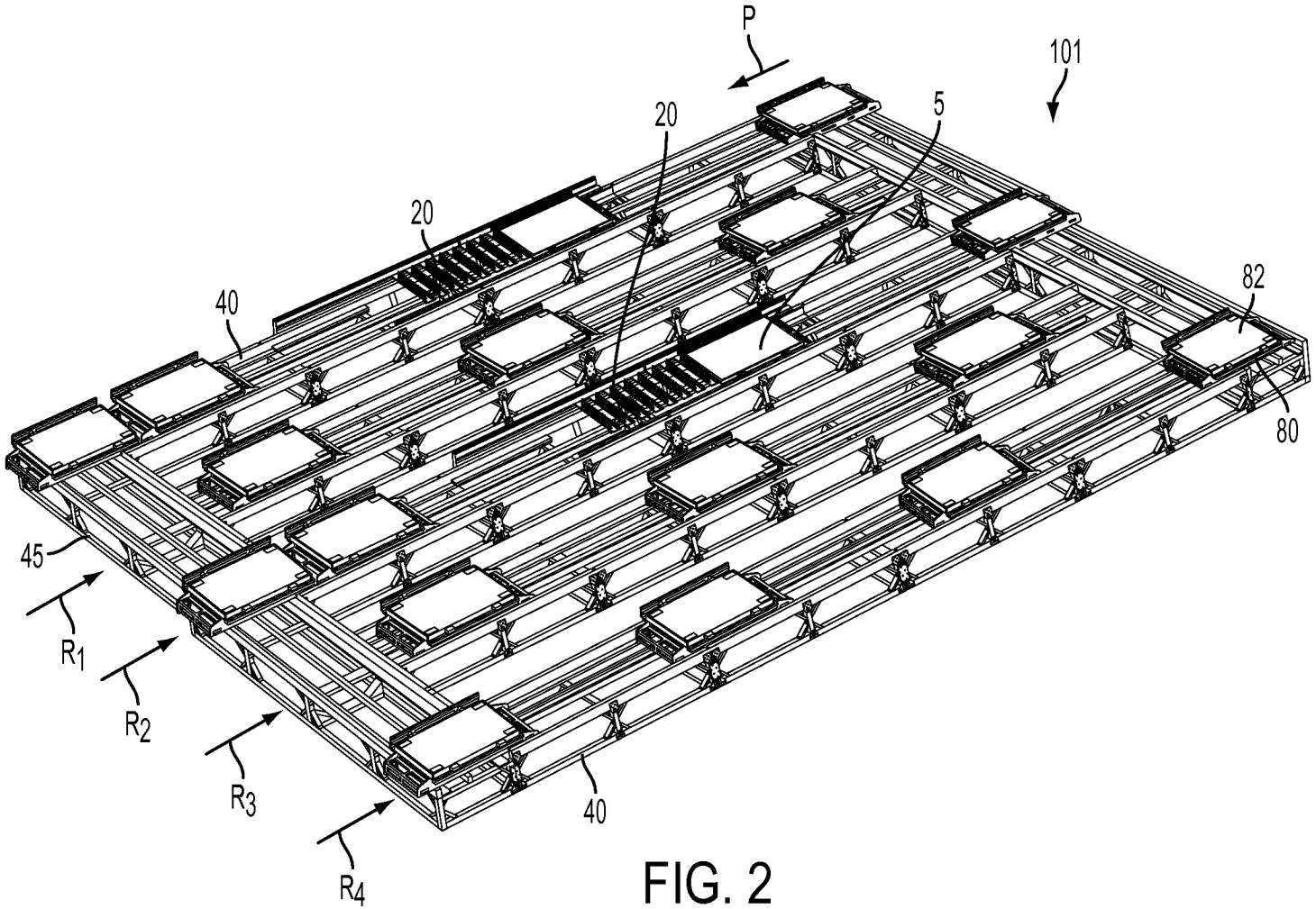
FIG. 2 is a perspective view of an alternative apparatus handling a sheet of substrate media in a marking assembly in accordance with aspect of the disclosed technologies.

In considering the modular aspect of the disclosed technologies as they relate to the track 40, it should be understood that the various linear segments of track 40 can comprise one or more units of linear track sections. For example, the linear track segment extending from the loading apparatus 92 to the sheet inverters 94 can be formed by one or more uniform sections of track. In this way, a linear track segment can be made longer or shorter. FIG. 2 shows an alternative apparatus 101 which includes many of the similar elements shown in apparatus 100, but providing additional routes $R_3$, $R_4$. The alternative apparatus 101 also includes a further marking zone 20 along the secondary route $R_2$. Additionally, the laterally extending track segments 45 have been made longer, enabling additional routes to be added.

Figure 3:
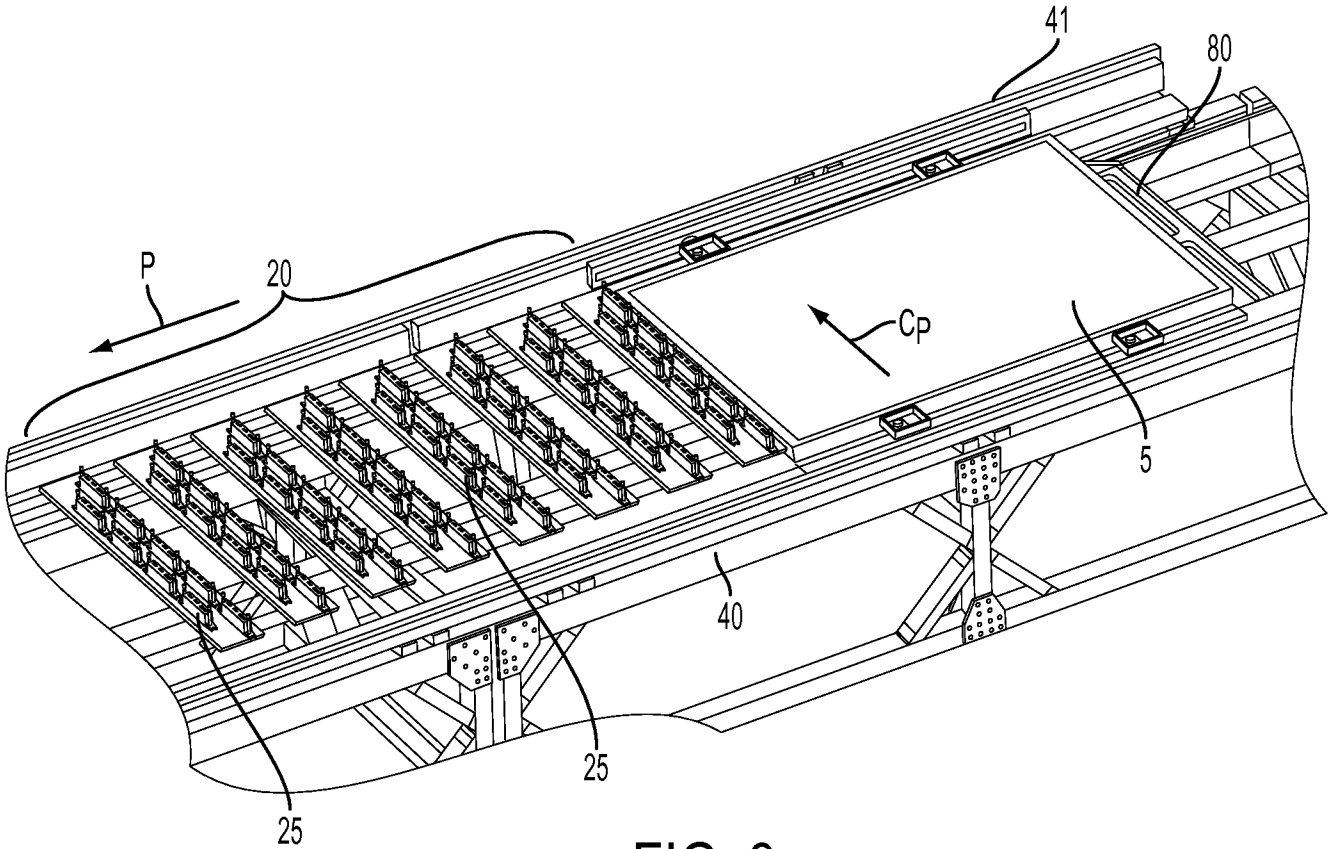
FIG. 3 is a relief view showing the marking zone of FIG. 1.

One aspect of the disclosed technologies uses inkjet printing in the marking zone 20 that lays down an image in a single lateral pass. FIG. 3 shows a relief view of the marking zone 20 from FIG. 1. As shown, the marking cart 80 is conveying a substrate media sheet 5 and has reached a point along the process path where the leading edge of the sheet 5 is just about to enter the marking zone 20. The sheet 5 will next pass once under the print heads 25 at a constant velocity. As the paper passes, an image panel is printed thereon. In this way, the inkjet print heads 25 move in a cross process direction laterally across the sheet 5 laying the image down preferably in a single pass. This enables a high through put or production rate, particularly considering the cart does not have to stop or slow down in the marking zone to receive its image. Additionally, a single pass image transfer is enabled by providing at least two staggered rows of individual print heads 25 of the same color. Eight of such paired staggered rows are shown extending laterally across the process path, so the inkjet print assembly does not need to move far in the cross-process direction to cover the full lateral extend of its print range. Thus, with a single lateral pass including only a short burst of lateral movement, the print heads 25 can transfer an image. It should be understood that while an 8-color configuration is shown in marking zone 20, a smaller or greater number of inkjet heads and/or colors can be used for a marking zone in accordance with the disclosure herein. In accordance with an aspect of the disclosed technologies herein any number of colors and curing stations can be integrated into the modular assembly.

Figure 4:
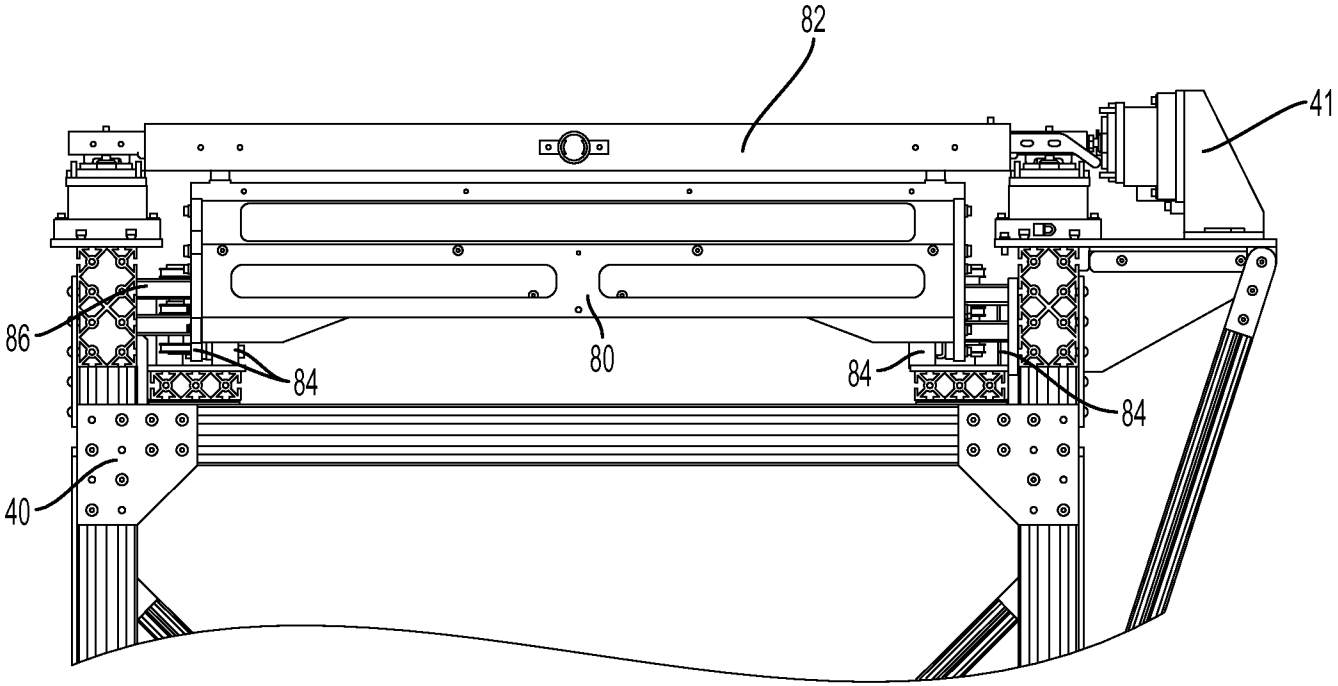
FIG. 4 is a view of the apparatus shown in FIG. 3 viewed looking upstream along the rail support track from downstream of the marking zone.

FIG. 4 shows a front elevation view of the platen cart 80 looking down a section of the track from a position downstream of the printing zone 20. As shown, the platen cart is provided with front and rear rolling bearing wheels 84 that support the platen cart 80 along bearing surfaces of the track. Also, the track includes lateral bearing walls that maintain the platen cart 80 appropriately positioned there between. The platen cart 80 can be further provided with spring loaded lateral bearing wheels 86 that help position the cart laterally along the track 40.

Figure 5:
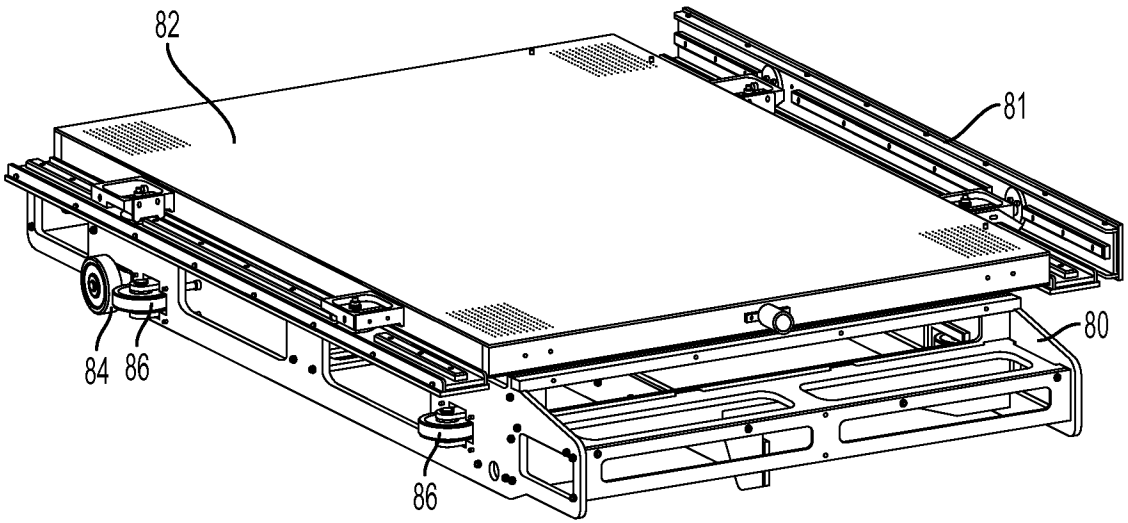
FIG. 5 is a perspective view of a platen cart in accordance with aspects of the disclosed technologies.
Figure 6:
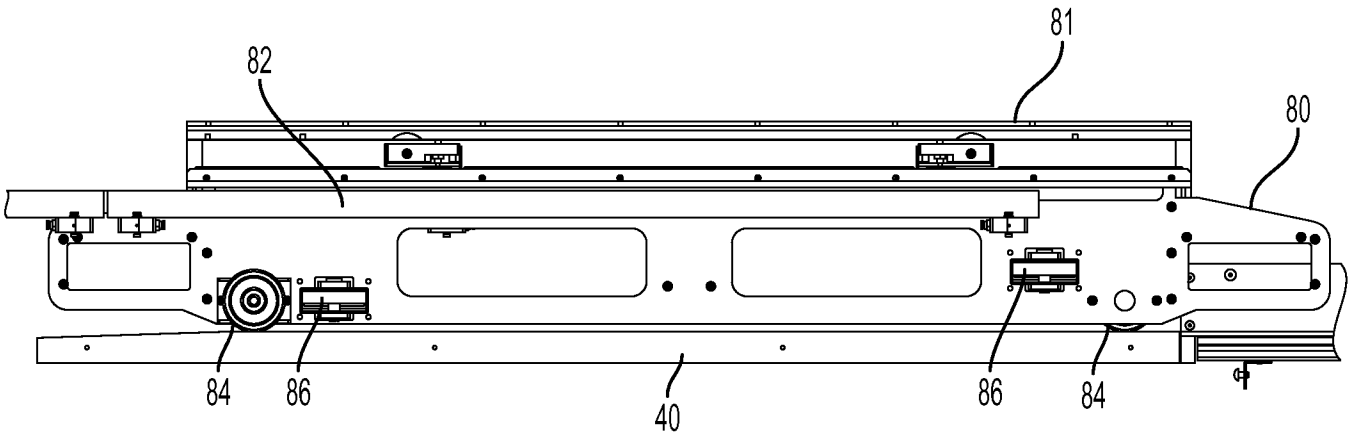
FIG. 6 is a side elevation view of the platen cart of FIG. 5.

FIG. 5 shows a perspective view of the platen cart 80 alone, while FIG. 6 shows a side elevation view of the platen cart 80 with only a portion of the bearing support surface of the track 40. FIGS. 5 and 6 also show the platen cart 80 can include a lateral stabilizer 81. The lateral stabilizer 81 is particularly used to stabilize the position of the platen cart 80 and the sheet 5 carried thereon in the cross-process direction Cp.

The individual platen carts 80 can include bearing wheels 84 for translating along bearing surfaces of the rail support track 40. Also, the platen cart 80 can include alternative bearing supports, such as non-contact bearing surfaces for gliding along air bearing rails. Multiple platen carts can be utilized for increased throughput to increase system image productivity, or likewise decreased for lower productivity/lower system cost. This strategy enables the customer to cost the system to meet their requirements and allow flexibility for productivity increase. Providing multiple platen carts 80 also allows for multimedia size and multimedia type to be interlaced into a job stream. The overall system can track and manage multiple platen carts with varied media sizes or types within the same job stream by providing unique tagging that distinguishes or identifies different platen carts. In this way, prior to a platen cart reaching a marking zone, a the tagging will trigger a signal so the system can accommodate the appropriate printing set points for the media size or types.

Also, a paper hold down force on the moving platen 82 can be enabled via one or more known techniques. For example, vacuum pressure can be provided from a bottom side of the sheet, mechanical gripping fingers could apply pressure to paper perimeter or electrostatic tacking forces could be used. Additionally, print head gap detection and correction can be enabled within the system. An array of sensors will be positioned upstream of the printing cell to detect for media height, flatness and edge curl. This strategy will prevent crashes into the print heads ensure media image quality associated with correct print head to paper gap.

Additionally, motion quality of the cart 80 and the sheet 5 carried thereon through the marking zone 20 can be improved by incorporating air bearing technology to glide the cart through the marking zone 20 during the printing process. Air bearing technology generally consists of a porous non-bearing support surface that emits pressurized air, supplied from below the porous surface. The air expelled through the porous surface creates a thin gaseous film above the porous surface over which a planar ski on the platen cart can glide. The gaseous layer, between the air bearing porous surface and the cart ski, provides a virtually frictionless motion that can enhance motion quality through the marking zone. Using non-contact bearing surfaces can reduce maintenance, while providing precision position control, particularly the vertical gap between the substrate media sheet 5 and the inkjet print heads. Similarly, such air bearings can be used to stabilize the lateral position of the platen cart 80. FIG. 4 shows a lateral track wall that includes an air bearing for providing non-contact bearing support to the lateral stabilizer 81, shown in FIGS. 4-6.

Additionally, an encoder positioned either on the platen cart or the track can monitor the speed of the platen cart 80. Used in conjunction with a system controller, knowing the precise speed of the platen cart enables a proper and precise print head firing sequence. A proper and precise firing sequence for the print heads improves/maintains quality color pixel placement. Also, ensuring the platen cart 80 translates through the marking zone at a constant velocity will further help image quality.

Another aspect of the disclosed technologies relates to handling large substrate media sheets, particularly those that can accommodate for an image zone of 60"×40" with ability to handle paper size of approximately 62"×42". However, it should be understood that an advantage of the disclosed system herein is that smaller paper sizes can still be accommodated, in addition to the larger sheets. Also, the system can be designed to handle even larger paper sizes, if desired. The use of a platen to handle large size cut sheets of substrate media, provides the option to introduce printing onto multi-substrate materials such as, acrylic glass (PMMA), canvas, wallpaper, laminates, card boards, metal, aluminum, etc. In this way, a system controller operated from a user interface allows the system to adapt and accommodate various types substrates or ones of varying dimensions. Also, the platen cart 80 or the track 40 can include sensors (not shown) for detecting substrate thickness. In addition to measuring sheet thickness, such sensors can also detect whether the leading edge of a sheet has raised off the platen 82. By automatically measured the sheet leading edge height or the sheet thickness, the gap between the print heads and the sheet can automatically be adjusted. This can prevent the sheet from inadvertently slamming directly into the print heads.

Figure 7:
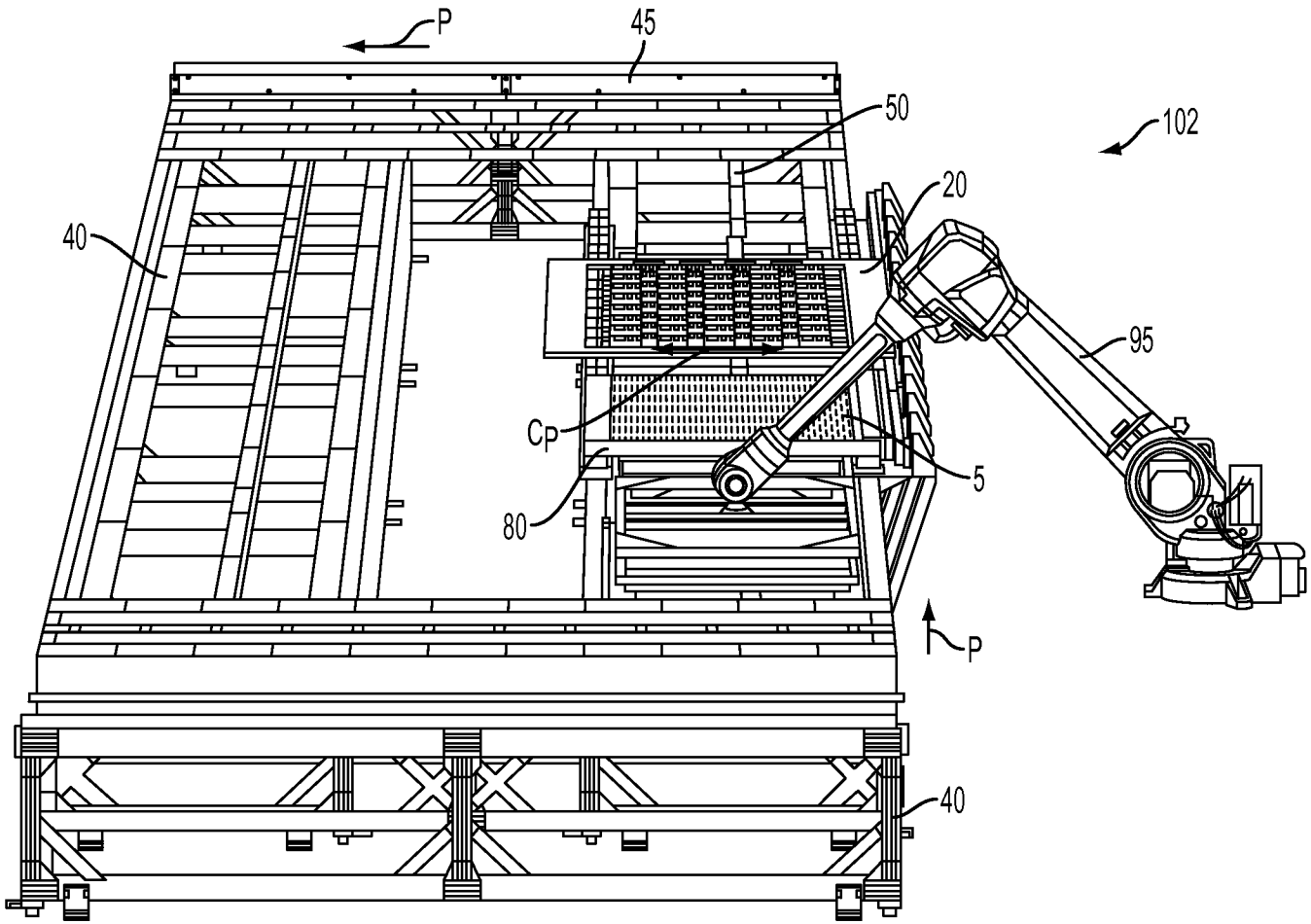
FIG. 7 a perspective view of an alternative apparatus handling a sheet of substrate media in a marking assembly in accordance with aspect of the disclosed technologies.

FIG. 7 shows an apparatus 102 for handling large sheets of substrate media in a marking assembly that includes only a single route coincident with the process path. Also, the apparatus 102 includes a sheet loader 95 that also serves as a sheet unloader. The sheet loader 95 uses a mechanical arm to grab a sheet 5 and position it on the platen cart 80 or remove it therefrom. The sheet loader 95 is similar to the automated arms 92, 94, 96 shown in FIG. 1. Such automated robotic arms 92, 94, 95, 96 can use vacuum suction, grippers or other known means for grabbing and moving large sheets of substrate media from one location to another. Alternative automated and/or robotic systems could be employed, such as a paper elevator feeder or material handling systems. Also, pick/place loading and manual loading can be integrated into the system.

The platen carts 80 in accordance with the various embodiments disclosed herein can be provided with an onboard motor or the propulsion imparted by a mechanism included as part of the track 40. A non-contact motor drive system could enable multiple platen carts to move freely without tether line (power or signal) constraints. One such drive system uses magnetic propulsion, which enables varying speeds, including stopping and restarting media cart movement as desired. FIG. 7 shows a central rail 50 that could house elements of such a magnetic propulsion system. Alternatively, a direct drive system using pulleys, cables, chains or other similar systems could be employed to drive the platen carts. Such direct drive systems could also be incorporated into the central rail 50 or disposed on one of the lateral extents of the track.

Figure 8:
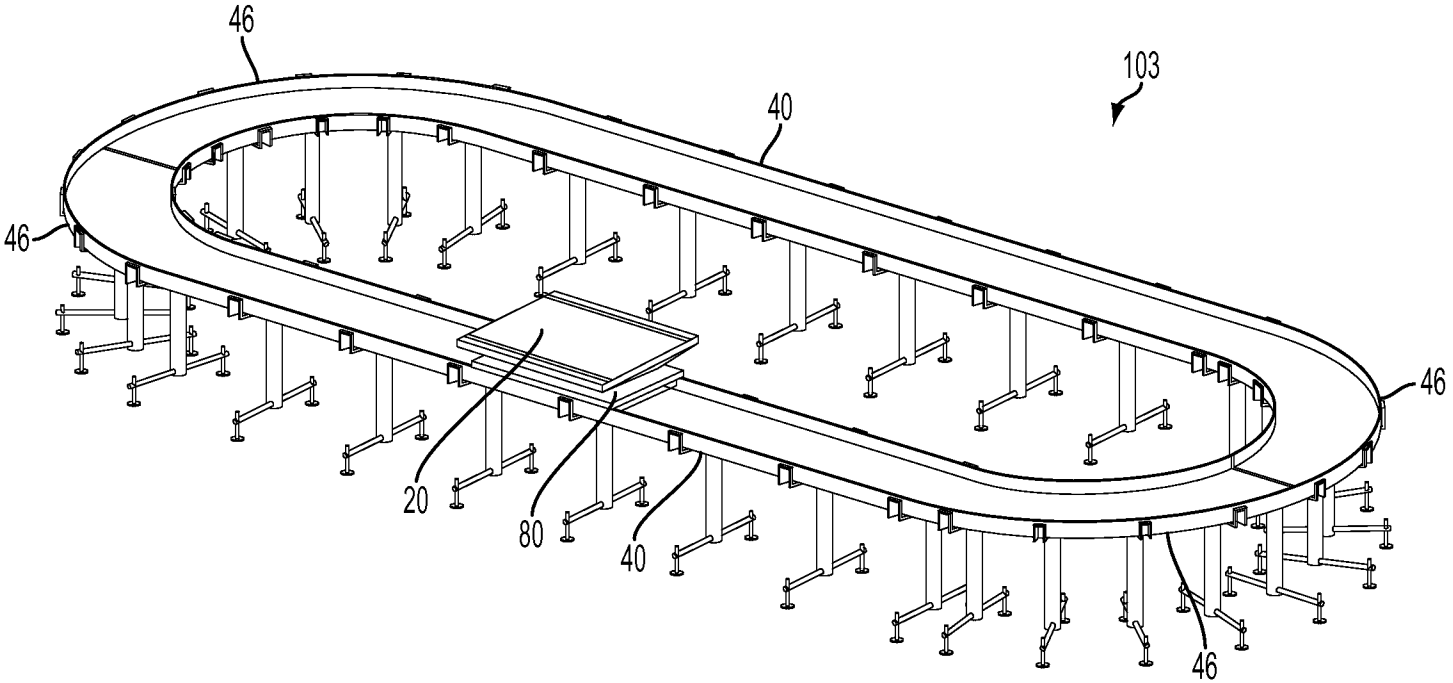
FIG. 8. a perspective view of an alternative apparatus handling a sheet of substrate media in a marking assembly in accordance with aspect of the disclosed technologies.

FIG. 8 shows a further alternative apparatus 103 that includes a rail support track 40 for conveying a platen cart 80. However, the apparatus 103 includes four modular segments of track 46 that are curved. In this way, the curved track segments 46 replace the perpendicular (i.e., laterally extending) shuttle track sections 45 in the earlier embodiments. It should be understood that a marking zone could be positioned almost anywhere along the process path of the apparatus 103, but preferably along the linear segments of track 40.

In accordance with aspects of the disclosed technologies, the platen cart 80, the printing system in the marking zone 20 or other automated parts of the apparatus 100-103 disclosed herein can be operated by a controller (not shown). The controller may also control any number of functions and systems within the overall apparatus and method described herein. The controller may include one or more processors and software capable of generating control signals. Through the coordinated control of the apparatus sub-elements, including the cart movement and the printing systems, the substrate media sheet 5 may be efficiently handled and marked. For example, the platen cart 80 can be made to accelerate, decelerate or even stop at various locations along the process path, if desired. Similarly, the timing and speed of a printing system can be controlled to maintain improved image quality.

It should be understood that this disclosed modular sheet handling assembly is not confined strictly as a marking system. The apparatus and methods disclosed herein allow customer and end-users to configure or reconfigure a production system relative to their job needs. Thus, a customer or end user can add, subtract or change modules such as duplex inversion, inserting, binding, gluing, folding, stitching, sorting, etc. Also, alternative routes or media paths can be added/subtracted to customize the system as desired. The disclosed technologies provide a modular architecture allowing the track and individual marking stations to be configured as desired. Also, any type of chosen print head can be integrated into the system to align a desired image quality reflective of customer needs and product cost.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. An apparatus handling a sheet of substrate media in a marking assembly, the apparatus comprising:

a rail support track forming a closed path, the rail support track including at least one alternate route within the closed path;

a first marking zone for marking a sheet of substrate media having dimensions of at least forty inches by sixty inches, a portion of the closed path extending through the first marking zone and the alternate route extending parallel to the portion of the closed path through the first marking zone, the first marking zone including a printing assembly moveable in a cross-process direction across the portion of the closed path extending through the first marking zone; and a first platen cart moveable along the rail support track, the first platen cart recirculating around the closed path and selectively moveable along the at least one alternate route, the first platen cart conveying the sheet of substrate media in a process direction along at least the portion of the closed path through the first marking zone, the printing assembly marking the sheet with no more than a single cross-process direction pass, wherein the rail support track further includes at least one lateral shuttle section for moving the first platen cart between parallel sections of the closed path and the at least one alternate route, said lateral shuttle section being a linear section extending in a straight direction, perpendicular to said parallel sections of the closed path.

2. The apparatus as defined in claim 1, wherein the rail support track includes modular track sections formed as reconfigurable units for changing the closed path.

3. The apparatus as defined in claim 1, further comprising:

a second platen cart moveable along the rail support track, the second platen cart moveable separate and apart from the first platen cart.

4. The apparatus as defined in claim 1, further comprising:

a second marking zone for marking the sheet of substrate media, the first platen cart conveying the sheet of substrate media along at least a portion of the closed path through the second marking zone.

5. The apparatus as defined in claim 1, wherein the printing assembly is selectively one of the following: an electrostatic printing assembly, a xerographic printing assembly, a liquid ink printing assembly, and a solid ink printing assembly.

6. The apparatus as defined in claim 2, wherein the closed path comprises exactly three parallel straight rail sections and the at least one lateral shuttle section comprises exactly two rail support track sections extending at opposed ends of the three parallel straight sections.

7. The apparatus as defined in claim 1, wherein the at least one lateral shuttle section further includes at least one supplemental translation cart, said supplemental translation cart having an upper portion oriented in the same direction as the section of the closed path extending through the first marking zone and a lower portion to convey the supplemental translation cart along the at least one lateral shuttle section.

8. A method of handling sheets of substrate media in a marking assembly, the method comprising:

positioning a first sheet of substrate media having dimensions of at least forty inches by sixty inches on a first platen cart, the first platen cart being disposed in a loading zone of a rail support track forming a closed path having at least two parallel straight sections, the first platen cart moveable in a process direction around the closed path returning the first platen cart to the loading zone, the rail support track further including at least one alternate route within the closed path extending parallel to the said at least two parallel straight sections;

moving the first platen cart in the process direction along the closed path to a first marking zone, the first platen cart conveying the first sheet of substrate media to the first marking zone, the first marking zone including a printing assembly moveable in a cross-process direction across the portion of the closed path extending through the first marking zone;

marking the sheet of substrate media in the first marking zone with no more than a single cross-process direction pass;

removing the sheet of substrate media from the first platen cart;

moving the first platen cart further in the process direction along the closed path at least until the first platen cart reaches the loading zone; and the first platen cart further conveying the first sheet of substrate media laterally between the at least two parallel straight sections of the closed path and the at least one alternate route via at least one lateral shuttle section, the lateral shuttle section being a linear of rail support track extending in a straight direction perpendicular to said parallel straight sections and said alternate route.

9. The method as defined in claim 8, further comprising:

positioning a second sheet of substrate media on the first platen cart in the loading zone; and moving the first platen cart in the process direction along the at least one alternate route within the closed path.

10. The method as defined in claim 8, wherein the printing assembly is an inkjet assembly.

11. The method as defined in claim 9, further comprising:

positioning a third sheet of substrate media on a second platen cart while the second platen cart is disposed in the loading zone and the first platen cart is disposed outside the loading zone, the second platen cart moveable in the process direction around the closed path returning the second platen cart to the loading zone.

12. The method as defined in claim 11, wherein the first platen cart is conveyed along a different path from that of the second platen cart.

13. The method as defined in claim 8, further comprising:

moving the first platen cart in the process direction along the closed path to a second marking zone, the first platen cart conveying the first sheet of substrate media to the second marking zone; and marking the sheet of substrate media in the second marking zone.

14. The method as defined in claim 10, wherein the positioning of the first sheet of substrate media on the first platen cart is performed by an automated robotic arm, the automated robotic arm receiving the sheet from off the first platen cart.

15. The method as defined in claim 8, wherein the first platen cart moves on wheels at least a portion of the closed path.

* * * * *